United States Patent [19]

Maruyama et al.

[11] 4,413,963

[45] Nov. 8, 1983

[54] SELF-CONTROLLABLE CAPACITY COMPRESSOR

[75] Inventors: Teruo Maruyama, Neyagawa; Shinya Yamauchi, Katano; Yoshikazu Abe, Neyagawa, all of Japan

[73] Assignee: Matsushita Electric Industrial Co., Ltd., Osaka, Japan

[21] Appl. No.: 341,608

[22] Filed: Jan. 22, 1982

[30] Foreign Application Priority Data

Jan. 29, 1981 [JP] Japan ..... 56-12427

[51] Int. Cl.[3] ..... F04C 29/08

[52] U.S. Cl. ..... 418/259

[58] Field of Search ..... 418/236–238, 418/259, 266–269, 150

[56] References Cited

U.S. PATENT DOCUMENTS 3,987,762 10/1976 Sawada ..... 418/266

*Primary Examiner*—Leonard E. Smith
*Assistant Examiner*—Jane E. Obee
*Attorney, Agent, or Firm*—Stevens, Davis, Miller & Mosher

[57] ABSTRACT

This invention relates to a compressor controllable in capacity, and more particularly to a compressor comprising a rotor having vanes slidably fitted thereto, a cylinder for receiving the rotor and vanes, side plates rigid on both sides of the cylinder and enclosing a space of a vane chamber defined by the vanes, rotor and cylinder at the sides thereof, and inlet and outlet ports each serving as a passage to communicate the vane chamber with the exterior, wherein the cylinder is oriented to have its top portion where a distance between the outer periphery of the rotor and the inner periphery of the cylinder becomes minimum. The improvement according to this invention is in that the inlet port is positioned so as to make $a(\theta)$ almost constant, or meet $a(\theta)=a$, in a range of $\frac{1}{2}\theta_s<\theta\leqq\theta_s$ and parameters of the compressor are determined to meet the following relation;

$$0.025<\theta_s a/V_o<0.080$$

where, $\theta$(radian): angle from the top portion of the cylinder to the leading end of the vane, which is held in contact with the inner periphery of the cylinder, around the center of revolution of the rotor, $\theta_s$(radian): angle $\theta$ at the completion of a suction stroke, $V_o$(cc): volume of the vane chamber when $\theta$ under goes $\theta_s$, and $a(\theta)$(cm$^2$): effective area of an inlet path from an evaporator to the vane chamber, thereby providing the compressor with less loss in refrigerating capacity while revolving at low speed and self-suppressing action allowing higher refrigerating capacity while revolving at high speed.

3 Claims, 19 Drawing Figures

SELF-CONTROLLABLE CAPACITY COMPRESSOR

BACKGROUND OF THE INVENTION

This invention relates to control on refrigerating capacity in an air conditioning system using a rotary compressor.

Rotary compressors of sliding vane type can be made to have smaller and simpler structure compared with reciprocating type compressors having intricate structure and the increased number of parts, so that the former has been recently utilized as compressors for use in car coolers. However, some problem has been encountered in the rotary type compressors compared with the reciprocating compressors as follows.

In the case of a compressor for use in the car cooler, a driving force of an engine is transmitted to a pulley of a clutch via a belt so as to drive a rotary shaft of the compressor. Therefore, refrigerating capacity of the compressor of sliding vane type is increased almost linearly in proportion to the number of revolutions of the vehicle engine.

On the other hand, when applying the conventional reciprocating compressor to the car cooler, follow-up capability of an inlet valve is deteriorated while revolving at high speed and compressed gas is not suctioned into a cylinder to the full extent, whereby its refrigerating capacity becomes saturated in high speed operation. More specifically, the reciprocating type compressor is automatically subjected to self-suppressing action on refrigerating capacity while traveling at high speed, while the rotary type compressor is subjected not to such self-suppressing action but the reduction in efficiency or the overcooled state (too much cooling) because of increased-compression work thereof. To solve the aforesaid problem in the rotary type compressor, there has been previously proposed a method such that a control valve variable in an opening area of its passage is provided in a passage communicating with the inlet valve of the rotary compressor and the opening area is reduced while revolving at high speeds in order to control capacity of the compressor by utilizing loss of suction. This method, however, has resulted in problems such that the aforesaid control valve has to be provided additionally, structure becomes complicated and manufacturing cost is increased. As an alternative method to avoid excessive capacity of the rotary compressor in high speed operation, there has also been previously proposed such structure as restraining the number of revolutions thereof within a predetermined value by utilizing a fluid clutch, planetary gears or so.

But, for example, the former using the fluid clutch undergoes increased energy loss due to frictional heat generated at the relatively moving surfaces, and the latter using the planetary gears leads to an increase in the number of parts and enlargement of its size. Accordingly, it is difficult to put the foregoing methods into practical use in these days where still more compact and simpler structure is increasingly required in the general trend to energy saving.

SUMMARY OF THE INVENTION

To solve the above mentioned problem attendant on the rotary compressor used in a refrigerating cycle for the car cooler, the inventors have studied in detail a transient phenomenon of pressure within a vane chamber when using the rotary compressor and have found as the result thereof that similar to the conventional reciprocating compressor, self-suppressing action imparts on refrigerating capacity while revolving at high speed also in the rotary type compressor by properly selecting and combinding parameters such as suction passage area, a discharged amount and the number of vanes. And the inventors have proposed Japanese Patent Application No. 55-134048 now under pending. This invention relates to the improvement of the above Japanese Patent Application. More specifically, according to this invention, an inlet port is so positioned that an effective area of suction passage communicating with a vane chamber in a compressor is kept at constant up to immediately before starting of a suction stroke, refrigerating capacity of the compressor is made to have more effective control characteristic, and manufacturing cost can be reduced due to simplification or omission of a machining process for an inlet groove.

DESCRIPTION OF THE DRAWING

FIG. 10 is a view showing an experimental unit for measuring an effective area of suction passage a;

DESCRIPTION OF THE PREFERRED EMBODIMENTS

Figure 1:
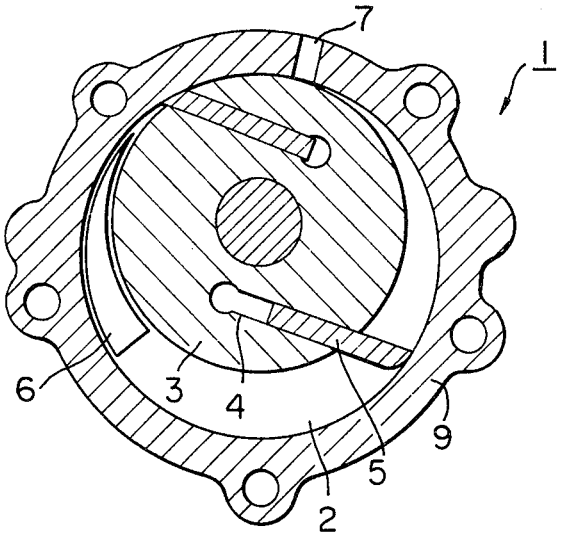
FIG. 1 PRIOR ART
FIG. 1 is a front sectional view of a conventional rotary compressor of sliding vane type.

Referring to FIG. 1, a rotary compressor of sliding vane type 1 includes a cylinder 9 having an internal cylindrical space therethrough, side plates (not shown) for enclosing each vane chamber 2 formed as a part of the internal space of the cylinder 9 at both sides thereof, a rotor 3 eccentrically disposed in the cylinder 9, and vanes 5 slidably fitted into grooves 4 which are formed in the rotor 3. The reference numeral 6 designates an inlet port formed in one of the side plates and 7 designates an outlet port formed in the cylinder 9. Each of the vanes 5 is rushed out toward the outside due to centrifugal forces as the rotor 3 is rotated, and the leading end surface of the vane 5 is slidably held against the inner wall of the cylinder 9 so as to prevent gas within the compressor from leaking out.

Figure 2:
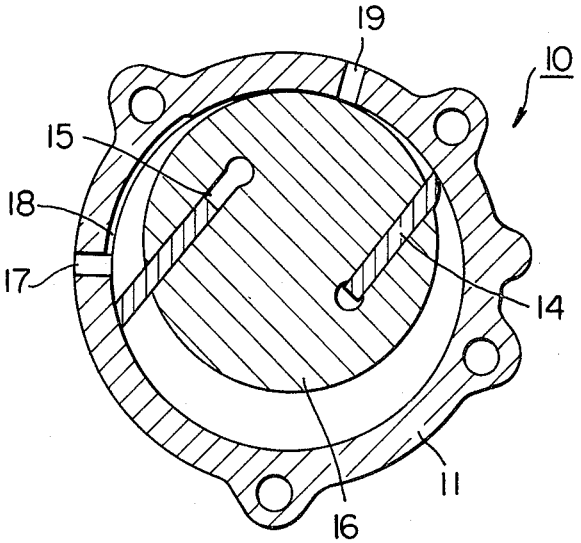
FIG. 2 is a front sectional view showing a first embodiment of a rotary compressor according to this invention.
Figure 3:
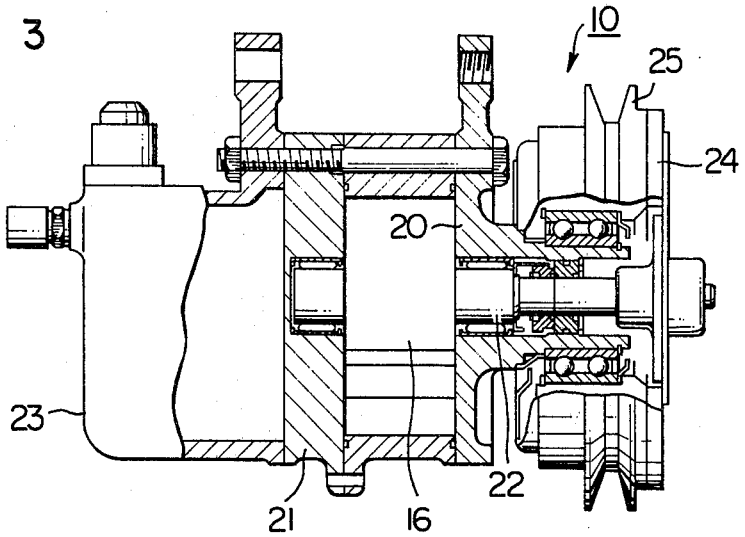
FIG. 3 is a side sectional view of the compressor of FIG. 2.

Referring to FIGS. 2 and 3 there is shown a sliding vane type compressor 10 with a pair of vanes, to which the present invention is applied, the compressor 10 includes a cylinder 11, vanes 14, sliding grooves 15 for the vanes, a rotor 16, an inlet port 17, an inlet groove 18 formed on the inner wall of the cylinder 11, and an outlet port 19.

Referring to FIG. 3, the compressor 10 additionally includes front and rear panels 20, 21 both serving as side plates, a rotary shaft 22, a rear case 23, a disk 24 of a clutch rigidly fixed to the rotary shaft 22, and a pulley 25.

The compressor 10 according to the first embodiment of this invention has the following specifications.

TABLE 1

| Parameter | Symbol | Experimental Data |
|---|---|---|
| Number of vanes | n | 2 |
| Effective area of suction passage | a | 0.450 $cm^2$ |
| Theoretical discharged amount | Vth | 86 cc/rev |
| Rotational angle of the leading end of vane at the completion of a suction stroke | $\theta_s$ | 270° |
| Width of cylinder | b | 40 mm |
| Inner diameter of cylinder | Rc | 33 $mm^R$ |
| Diameter of rotor | Rr | 26 $mm^R$ |

A rotating angle $\theta$ of the leading end of vane at the completion of a suction stroke in Table 1 is defined as follows.

Figure 4A:
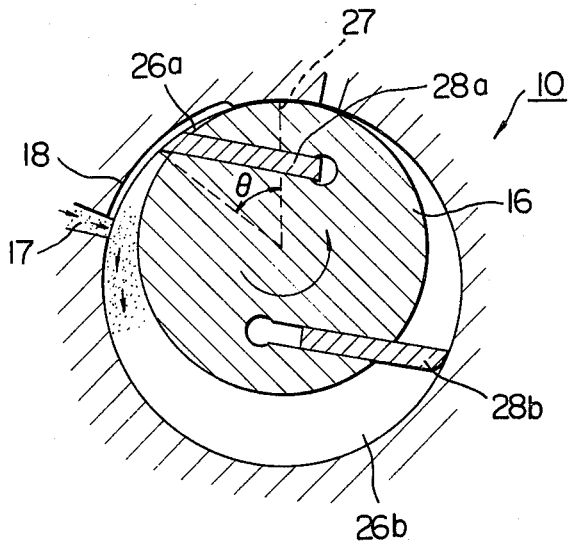
FIG. 4A is a view showing the relation among a rotor, vanes and other components in their positions immediately after starting of a suction stroke in the compressor of FIG. 2.
Figure 4B:
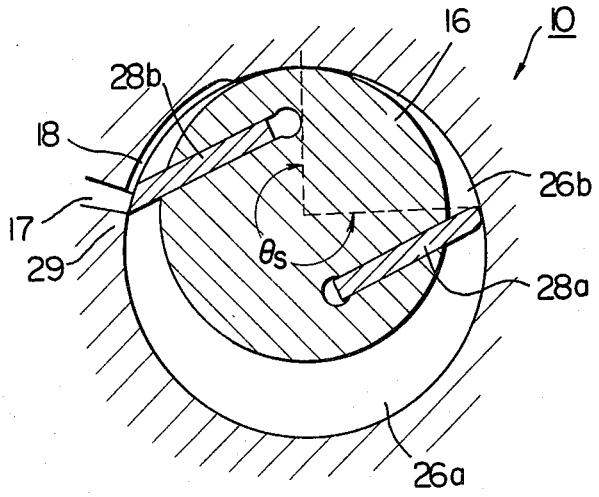
FIG. 4B is a view showing the relation among the rotor, vanes and other components in their positions at the completion of a suction stroke in the compressor of FIG. 2.

In FIGS. 4A and 4B, the reference numeral 26*a* designates a vane chamber A, 26*b* a vane chamber B, 27 the top portion of the cylinder 11, 28*a* a vane A and 28*b* a vane B, respectively.

Let it be assumed that $\theta=0$ represents a position where the leading end of the vane passes the top portion 27 of the cylinder as the rotor 16 rotates about its center as the center of revolutions. With $\theta=0$ being as the origin, $\theta$ is given by an angle from the origin to any position of the leading end of the vane. As regards the vane chamber 26*a*, FIG. 4A shows a state immediately after the vane 28*a* has passed the top portion 27 of the cylinder and a suction stroke has started. Refrigerant is supplied to the vane chamber 26*a* through the inlet groove 18 and to the vane chamber 26*b* directly from the inlet port 17 as shown by arrows.

FIG. 4*b* shows a state at the completion of a suction stroke for the vane chamber 26*a*, the leading end of the vane 28*b* locating at the position of the inlet port 17. At this time, volume of the vane chamber 26*a* defined by the vanes 28*a*, 28*b* becomes maximum.

Figure 5:
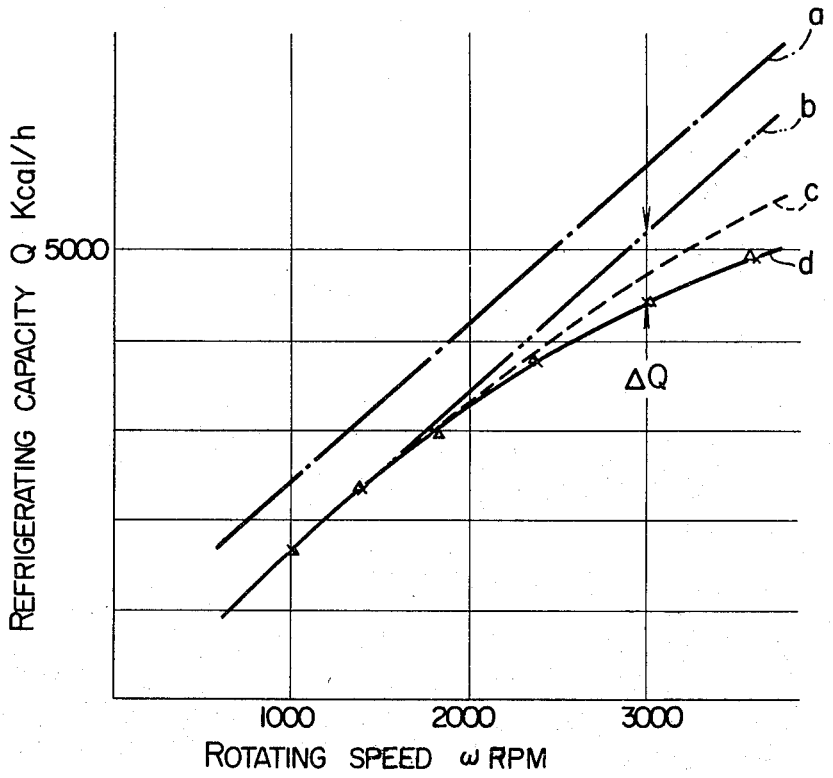
FIG. 5 is a measured graph showing refrigerating capacity Q versus rotating speed $\omega$ in the compressor of FIG. 2 and the conventional compressors.

There is shown in FIG. 5 the measured result of refrigerating capacity versus rotating speed in the compressor according to this invention adopting the parameters as mentioned above.

Besides, the measured result in FIG. 5 is obtained by using a calorimeter of secondary refrigerant type under conditions as given in Table 2.

TABLE 2

| Parameter | Symbol | Experimental Data |
|---|---|---|
| Pressure of refrigerant at the inlet side | Ps | 3.18 $Kg/cm^2$ abs |
| Temperature of refrigerant at the inlet side | $T_A$ | 283° K. |
| Pressure of refrigerant at the outlet side | Pd | 15.51 $Kg/cm^2$ abs |
| Rotating speed | $\omega$ | 600~5000 rpm |

In FIG. 5, a characteristic curve a represents refrigerating capacity determined from the theoretical discharged amount with no loss in refrigerating capacity. Then, b represents a typical characteristic of refrigerating capacity in the conventional rotary compressor, c represents the same in the conventional compressor of reciprocating type, and d represents the same in the first embodiment of the compressor according to this invention.

Figure 6:
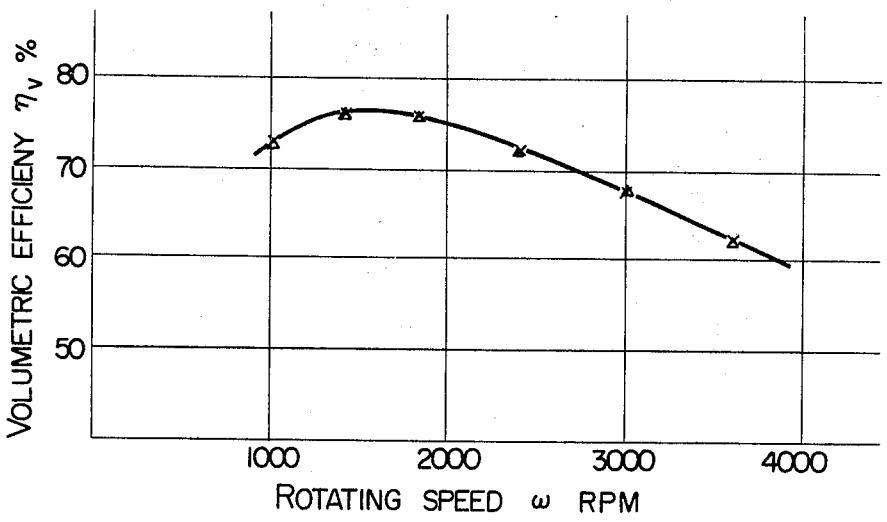
FIG. 6 is a measured graph showing volumetric efficiency $\eta v$ versus rotating speed $\omega$ in the compressor of FIG. 2.

FIG. 6 shows measured data of volumetric efficiency versus rotating speed in the compressor according to this invention.

The compressor according to the first embodiment of this invention showed an ideal characteristic of refrigerating capacity as represented by the curve d in FIG. 5, and this result was different from such common sense in the past that the rotary compressor is subjected to excessive capacity while revolving at high speed. In other words, it can be said in the rotary type compressor according to this invention that;

(I) Reduction of refrigerating capacity due to loss of suction was small while revolving at low speed.

Although it is seen from FIG. 6 that volumetric efficiency is reduced below $\omega=1400$ rpm, this is resulted from leakage of refrigerant through the slidably contacting portions.

The reciprocating type compressor with self-suppressing action in its refrigerating capacity is characterized in having less loss of suction even while revolving at low speed. The rotary compressor according to this invention was found also to have a comparable characteristics with that of the reciprocating type compressor in this respect. (Two characteristic curves b, c coincide with each other while revolving at low speed).

(II) Suppressing effect in refrigerating capacity superior to that in the conventional reciprocating type compressor was obtained while revolving at high speed.

(III) The suppressing effect was produced when the number of revolutions exceeds 1800–2000 rpm. Application of the compressor according to the present invention to a compressor for use in a car cooler was able to realize a refrigerating cycle with ideal energy saving and comfortable feeling.

The results (I)-(III) in the above can be regarded as ideal conditions for a refrigerating cycle of the car cooler, and the most important feature of the present invention resides in that such results was achieved without using any additional new components compared with the conventional rotary compressor.

More specifically, the present invention makes it possible to realize the compressor controllable in capacity without impairing any of such advantageous features of the rotary type compressor as permitting small, light and simple structure. In general, for a polytropic change in a suction stroke of the compressor, the more inlet pressure is lowered and specific weight is small, the more total weight of refrigerant within the vane chamber is reduced and compression work becomes small. As a result, the compressor according to this invention that is automatically subjected to reduction in total weight of refrigerant before entering into a compression stroke due to the increased rotating speed, necessarily leads to reduction in driving torque while revolving at high speed.

Thus, according to the compressor of this invention, capacity control can be conducted without effecting any dead mechanical work leading to the aforesaid loss of compression, thereby resulting in a refrigerating cycle with high efficiency and suitable for energy saving. Moreover, as fully described later, the present invention is characterized in effectively utilizing a transient phenomenon of pressure within the vane chamber through the proper combination of various parameters in the compressor, so that the present compressor does not require any additional operating part such as a control valve. As a sequence, the compressor according to this invention has high reliability.

Furthermore, since refrigerating capacity is varied successively in the present compressor, there occurs no such unnatural cooling characteristic attendant on discontinuous switching as experienced in the case using a control valve and hence successive control in refrigerating capacity can be achieved while rendering comfortable feeling.

In the following, there will be described characteristic analysis which has been carried out to fully grasp a transient phenomenon of refrigerant pressure serving as important basis of the present invention.

A transient characteristic of pressure within the vane chamber can be represented by the energy equation as follows;

$$\frac{Cp}{A} GT_A - Pa\frac{dVa}{dt} + \frac{dQ}{dt} = \frac{d}{dt}\left(\frac{Cv}{A}\gamma a\ Va\ Ta\right) \quad (1)$$

where G: weight flow rate of refrigerant, Va: volume of vane chamber, A: thermal equivalent of work, Cp: specific heat at constant pressure, $T_A$: temperature of refrigerant at the inlet side, $\kappa$: specific heat ratio, R: gas constant, Cr: specific heat at constant volume, Pa: pressure within vane chamber, Q: calorie, $\gamma a$: specific weight of refrigerant within vane chamber, and Ta: temperature of refrigerant within vane chamber. Also, let it be assumed in the following equations (2)-(4) that a: effective area of inlet path, g: acceleration of gravity, $\gamma A$: specific weight of refrigerant at the inlet side, and Ps: pressure of refrigerant at the inlet side.

In the Equation (1), the first term of the left side represents a thermal energy of refrigerant brought into the vane chamber via the inlet port per unit time, the second term thereof represents work conducted by refrigerant pressure against the exterior per unit time, and the third term thereof represents thermal energy flowing into the vane chamber from the exterior through the peripheral wall per unit time. The right side of the Equation (1) represents an increase of internal energy in the system per unit. Assuming that refrigerant conforms to rules for ideal gas and a suction stroke of the compressor is subjected to an adiabatic change because of its rapid process, the following equation is obtained from $\gamma a = Pa/RTa$ and $dQ/dt = 0$;

$$G = \frac{dVa}{dt}\left(\frac{A}{CpT_A} + \frac{1}{kRT_A}\right) Pa + \frac{Va}{kRT_A}\ \frac{dPa}{dt} \quad (2)$$

Also, using the relative equation of $(1/R) = (A/Cp) + (1/\kappa R)$, $$G = \frac{1}{RT_A}\cdot\frac{dVa}{dt}\cdot Pa + \frac{Va}{\kappa RT_A}\ \frac{dPa}{dt} \quad (3)$$

By applying the theory on nozzles, the weight flow rate of refrigerant passing through the inlet port is given as;

$$G = a\sqrt{2g\gamma_A Ps\frac{\kappa}{\kappa-1}\left[\left(\frac{Pa}{Ps}\right)^{\frac{2}{\kappa}} - \left(\frac{Pa}{Ps}\right)^{\frac{\kappa+1}{\kappa}}\right]} \quad (4)$$

Figure 7:
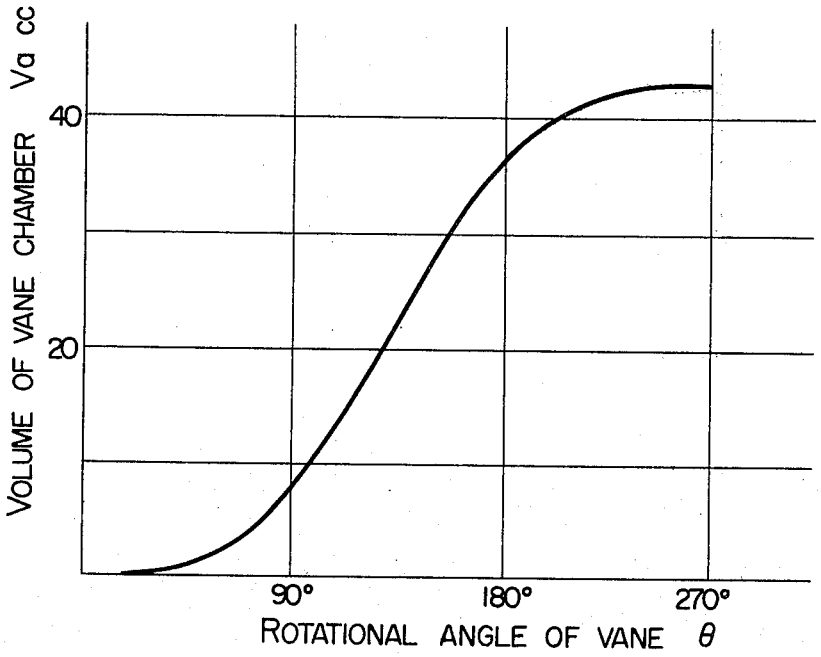
FIG. 7 is a graph showing the relation between volume of a vane chamber Va and a travel angle of vane $\theta$ in the compressor of FIG. 2.

Accordingly, a transient characteristic of pressure within the vane chamber Pa is obtained by solving simultaneous equations (3) and (4). Besides, assuming $m = Rr/Rc$, volume of the vane chamber $Va(\theta)$ is represented as follows;

$$V(\theta) = \frac{bRc^2}{2}\left\{(1-m^2)\theta + \frac{(1-m)^2}{2}\sin 2\theta - (1-m)\sin\theta \times \sqrt{1-(1-m)^2\sin^2\theta} - \sin^{-1}[(1-m)\sin\theta]\right\} + \Delta V(\theta) \quad (5)$$

when $0 < \theta < \pi$, $Va(\theta) = V(\theta)$ when $\pi < \theta < \theta s$, $Va(\theta) = V(\theta) - V(\pi - \theta)$ In this Equation (5), $\Delta V(\theta)$ is a correction term added in consideration of the fact that the vanes are eccentrically disposed with respect to the center of the rotor, the order of $\Delta V(\theta)$ being of 1-2% in normal. The characteristic curve of $Va(\theta)$ with $V(\theta) = 0$ is shown in FIG. 7.

Figure 8:
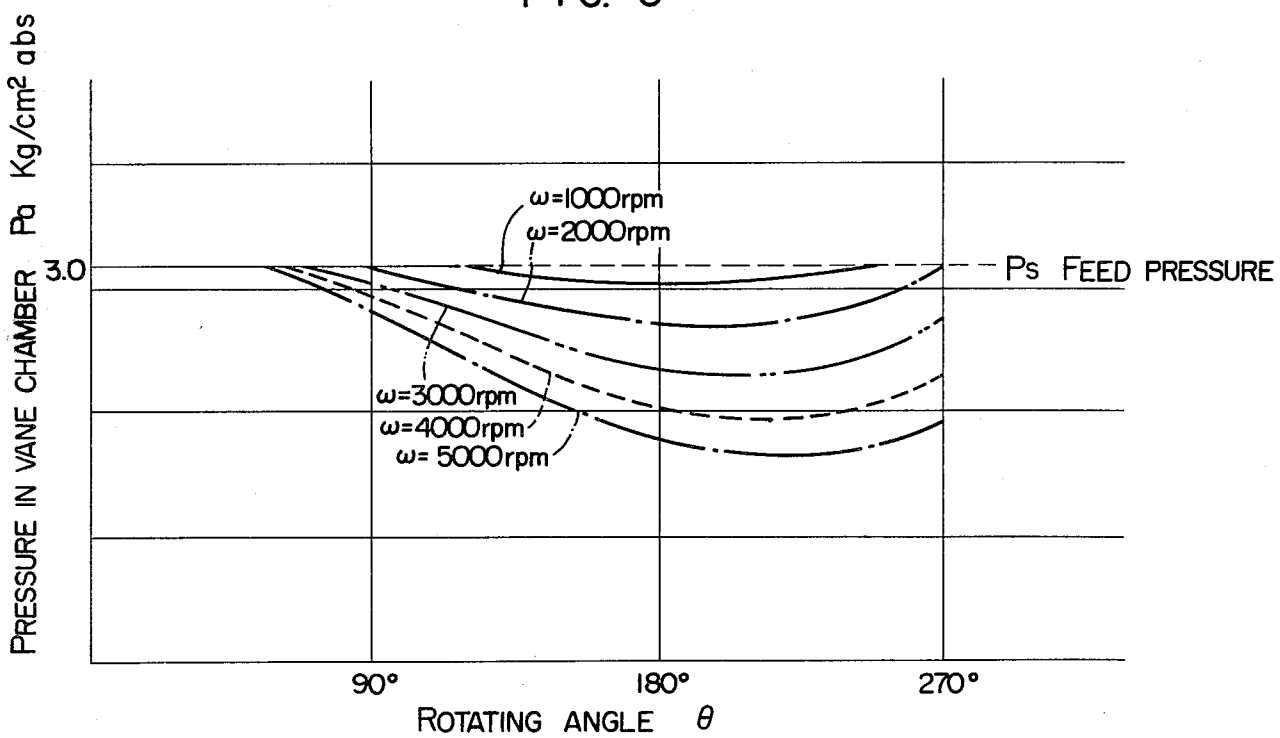
FIG. 8 is a graph showing one example of a transient characteristic in the compressor of FIG. 2.

FIG. 8 shows a transient characteristic of pressure within the vane chamber which was obtained from the Equations (3)-(5) and conditions in Tables 1, 2 under the initial condition of $t = 0$ and $Pa = Ps$ using the rotating speed as a parameter. Also, Freon is normally used as refrigerant in a refrigerating cycle for car coolers, so that the analysis was conducted assuming that $\kappa = 1.13$, $R = 668$ Kg.cm/°K., $\gamma_A = 16.8 \times 10^{-6}$ kg/cm$^3$ and $T_A = 283°$ K.

Referring to FIG. 8, while revolving at low speed ($\omega = 1000$ rpm), pressure within the vane chamber Pa has already reached to a level of supply pressure $Ps=3.18$ kg/cm$^2$ abs at nearby $\theta=260°$ before the completion of a suction stroke, and hence the pressure within the vane chamber is not subjected to any loss at the completion of a suction stroke. As the rotating speed is increased, supply of refrigerant cannot follow a volume change of the vane chamber, whereby loss of pressure at the completion of a suction stroke ($\theta=270°$) is gradually increased. For example, if $\omega=4000$ rpm, loss of pressure $\Delta P$ with respect to the supply pressure Ps becomes 1.37 kg/cm$^2$. Then, resultant reduction in total weight of suctioned refrigerant leads to remarkable reduction in refrigerating capacity.

By the way, there will be now proposed a method for grasping the relation between the various parameters and the effect of capacity control through rearrangement of the Equations (3) and (4) by using the following approximate function in place of using the Equation (5) which was used to obtain volume of the vane chamber Va.

Assuming that Vo is maximum suction volume for refrigerant and $\psi=Qt=(\pi\omega/\theta_s)t$, an angle $\theta$ is converted to $\psi$. On this occassion, $\psi$ is given by the Equation (6), for example, as an approximate function at least meeting such conditions that $\psi$ is varied from 0 to $\pi$, $Va(0)=0$ and $Va'(0)=0$ at $t=0$, and $Va(\pi)=Vo$ and $Va'(\pi)=0$ at $t=\theta_s/\omega$ upon the completion of a suction stroke.

$$Va(\psi)\approx Vo/2\,(1-\cos\psi) \tag{6}$$

Also, substituting $\eta=Pa/Ps$, $$G=\frac{\Omega Vo}{2}\,\frac{Ps}{RT_A}\left\{\sin\psi\cdot\eta+\frac{1}{\kappa}(1-\cos\psi)\frac{d\eta}{d\psi}\right\} \tag{7}$$

Thus, the Equation (4) becomes as follows;

$$G=a\sqrt{Ps\cdot\gamma_A 2g\cdot\frac{\kappa}{\kappa-1}\left[\eta^{\frac{2}{\kappa}}-\eta^{\frac{\kappa+1}{\kappa}}\right]} \tag{8}$$

Therefore, from the aforesaid Equations (7) and (8), $$K_1 f(\eta)=\sin\psi\cdot\eta+(1/\kappa)(1-\cos\psi)\,(d\eta/d\psi) \tag{9}$$

$K_1$ is a dimentionless value and represented by the following equation;

$$K_1=\frac{2a\theta s}{Vo\pi\omega}\cdot\sqrt{2gRT_A} \tag{10}$$

In the case of the sliding vane type compressor, there is normally assumed the relation of $Vth=n\times Vo$, where Vth is a theoretical discharged amount and n is the number of vanes, so that the Equation (10) is changed into;

$$K_1=\frac{2a\theta sn}{V_{th}\pi\omega}\sqrt{2gRT_A} \tag{11}$$

In the above Equation (9), since the specific heat ratio is a constant determined depending the kind of refrigerant, the solution of the Equation (9)$\eta=\eta(\psi)$ is uniquely determined at all times under such condition that $K_1$ is held at constant.

More specifically, in the compressors arranged to have identical $K_1$, loss of pressure within the vane chamber becomes equal to each other at the completion of a suction stroke and there occurs capacity control at the same proportion with respect to the refrigerating capacity Q Kcal that is obtained in the case having no loss.

Now, a rate of pressure drop $\eta p$ is defined as follows assuming that pressure within the vane chamber Pa becomes to Pas at the completion of a suction stroke;

$$\eta p=\left(1-\frac{Pas}{Ps}\right)\times 100 \tag{12}$$

Figure 9:
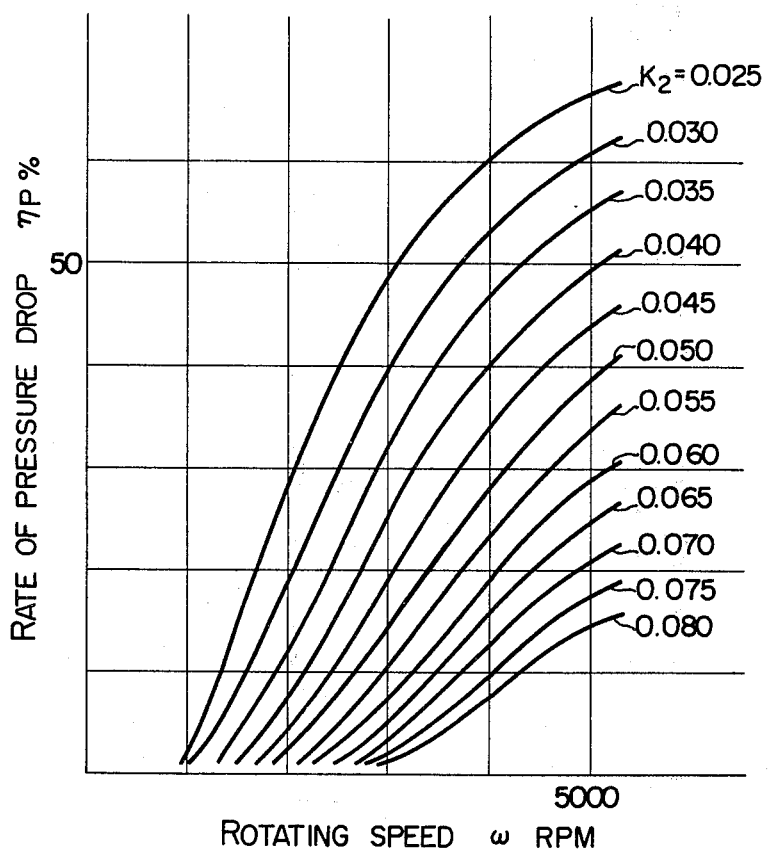
FIG. 9 is a graph showing a characteristic of rate of pressure drop $\eta p$ versus rotating speed $\omega$ in the compressor of FIG. 2.

FIG. 9 shows the rate of pressure drop $\eta p$ which was obtained from the Equations (3) and (4) under the condition of $T_A=283°$ K. by using $\Delta T=10$ deg as a degree of superheat and substituting $K_2$ difined as $K_2=a\theta_s/Vo$.

As clear from FIG. 9, it is possible to make loss of pressure much small white revolving at low speed and to effectively generate fair loss of pressure only while revolving at high speed by properly setting those parameters of the compressor. In this condition, a characteristic of loss of pressure versus rotating speed includes a region to be regarded as an in sensible region in low speed operation. The presence of this insensible region serves as the most important point for achieving more effective capacity control in the rotary compressor according to this invention.

Now, when calculating the above parameter: $K_2$ from specifications shown in Table 1, it is obtained that $$K_2=(0.450\times 4.71)/43=0.0493.$$

When determining the rate of pressure drop at $\omega=3000$ rpm from FIG. 9 with $K_2$ having the above value, this rate is given as $\eta p=15\%$. It is generally understood that a rate of pressure drop is substantially equal to that of refrigerating capacity. According to the experimental result as shown in FIG. 6, the drop rate of refrigerating capacity becomes 16.0%, whereby the theoretical value shows good approximation to the experimental value.

Meanwhile, the result of travel tests using actual vehicles equipped with the compressor has clarified the requirements for capacity control permitting the sufficient performance in practical use of a refrigerating cycle for car coolers. These requirements can be summarized as a typical case as follows;

(I) At $\omega=1800$ rpm, a drop rate of refrigertating capacity (loss of pressure) should be less than 5%.

(II) At $\omega=3600$ rpm, a drop rate of refrigerating capacity should be above 10%.

A range of $K_2$ meeting the above (I) and (II) is given by;

$$0.040<K_2<0.075 \tag{13}$$

Therefore, the compressor controllable in capacity and having the performance of the above (I) and (II) can be realized by selecting the parameters such as a, $\theta_s$, n and Vth of the compressor so as to meet the Equation (13). However, the Equation (13) is effective for such $K_2$ as obtained under the condition of refrigerant temperature $T_A=283°$ K., and both side values in the Equation (13), namely a range of $K_2$, is somewhat varied depending on the value of $T_A$.

When Freon is employed in the refrigerating cycle for car coolers, the evaporating temperature of refrigerant $T_A$ is determined in consideration of the following points.

Heat exchanging rate of an evaporator becomes larger with the increasing difference in temperature between external air and circulated refrigerant, so that possibly lower refrigerant temperature $T_A$ is preferred. But, when the refrigerant temperature is lowered below the freezing point of moisture contained in air, the moisture in air is frozen in pipings, thus resulting in remarkable reduction of heat exchanging efficiency. It is preferable, therefore, that the refrigerating cycle is so designed that refrigerant temperature will be normally kept above the freezing point of moisture. In the environment of flowing air, the optimum $T_A$ is about $-5°$ C. and $T_A$=about $-10°$ C. is an allowable upper limit from a view point of practical use. The evaporating temperature becomes higher in such worse conditions for heat exchanging as encountered during low speed traveling or idling. The heat exchanging rate can be raised by increasing a flow rate of a blower or a surface area of the evaporator, but these methods have some difficuly due to practical limitations attendant on installation thereof to vehicles. As a result, the upper limit value of refrigerant temperature $T_A$ is about 10° C. from a view point of practical use and preferably the refrigerant temperature $T_A$ should be lowered down to about 5° C. Therefore, a range of $T_A$ allowing the refrigerating cycle free of troubles in practical use is given by;

$$-10° \text{ C.} < T_A < 10° \text{ C.} \quad (14)$$

For reference, refrigerant supply pressure Ps on this occassion resides in the following range;

$$2.26 \text{ Kg/cm}^2 \, abs < Ps < 4.26 \text{ Kg/cm}^2 \, abs \quad (15)$$

Further, considering $\Delta T = 10$ deg as a degree of superheat into $T_A$ in the Equation (14), $$0° \text{ C.} < TA < 20° \text{ C.} \quad (16)$$

Accordingly, a range of $K_2$ determined by the Equation (13) can be corrected utilizing the Equation (16). More specifically, this correction is just so effected that the upper limit value of $K_2$ should be increased by 1.8% and the lower limit value thereof should be reduced by 1.7%, respectively, depending on the value of $T_A$.

By the way, an effective area of suction passage in this invention has such measning as follows.

If there is found a position where a fluid passage from an outlet of the evaporator to the vane chamber of the compressor becomes minimum in its cross sectional area, the value of an effective area of suction passage a can be rougly estimated by multiplying the minimum cross sectional area by a reduced current factor =0.7–0.9. More strictly, an effective area of suction passage is defined as a value obtained from an experiment as stated below which is carried out in accordance with the procedures specified in JISB 8320 or other regulations.

Figure 10:
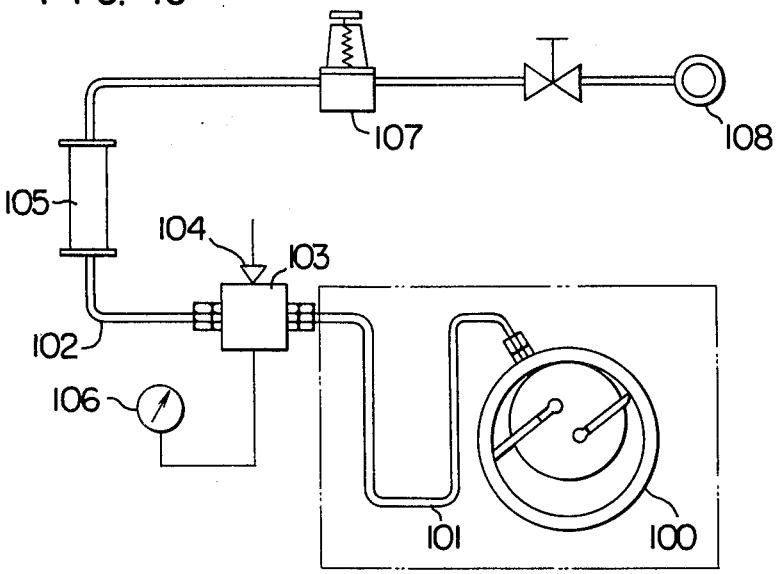

Referring to FIG. 10 in which there is illustrated a typical unit for such experiment, this experimental unit includes a compressor 100, a pipe 101 for connecting an evaporator with an inlet port of the compressor when it is installed on vehicles, a supply pipe 102 for highly pressurized air, a housing 103 for connecting between the both pipes 101 and 102, a thermocouple 104, a flow rate meter 105, a pressure gauage 106, a pressure control valve 107 and a source of highly pressurized air.

In FIG. 10, a section encircled by a chain line corresponds to the compressor to which the present invention is applied. In this connection, if there is a throttled portion rendering non-neglible fluid resistance within the evaporator used for the expermental unit, the corresponding throttle has to be fitted in the pipe 101 additionally.

Now, when measuring an effective area of suction passage a of the compressor with such structure as shwon in FIGS. 2 and 3, for example, the experiment can be performed in a state after removing the disk 24 and pulley 25 of the clutch and disassembling the front panel 20 from the cylinder 11.

Let it be assumed that pressure of the source for highly pressurized air is $P_1$ Kg/cm$^2$ abs, atmospheric pressure is $P_2$=1.03 Kg/cm$^2$ abs, a specific heat ratio of air is $\kappa_1$=1.4, specific weight of air is $\kappa_1$, and the acceleration of gravity is g=980 cm/sec$^2$ and also a weight flow rate obtained under these conditions is $G_1$, an effective area of suction passage a is given by the equation below;

$$a = G_1 / \sqrt{2g\gamma_1 P_1 \frac{\kappa_1}{\kappa_1 - 1}\left\{\left(\frac{P_2}{P_1}\right)^{\frac{2}{\kappa 1}} - \left(\frac{P_2}{P_1}\right)^{\frac{\kappa 1+1}{\kappa 1}}\right\}} \quad (17)$$

where, high pressure $P_1$ is determined to meet the relation of $0.528 < P_2/P_1 < 0.9$.

The followng results have been obtained through travel tests using actual vehicles equipped with the compressors having various values of the parameters $K_2$.

TABLE 3

| Number of Revolutions | Effect of Capacity Control (Pressure Drop Rate) | $K_2$ | Test Results |
|---|---|---|---|
| | 22.5% | 0.025 | Efficiency was slightly reduced in low speed operation. But with the compressor with Vth above 95 cc/rev being used, sufficient refrigerating capacity was obtained. |
| 1800 rpm | 9.0% | 0.035 | There occurred certain loss of efficiency. But it was enoughly allowable for practical use. |
| | 4.5% | 0.040 | Reduction of efficiency was small. A refrigerating cycle with ideal energy saving and high efficiency can be realized. |
| 4600 rpm | 21.5% | 0.065 | A state allowing the best effect of capacity control and energy saving was obtained in high speed operation. |
| | 18.0 | 0.070 | Comparable effect with the prior reciprocating type compressor |

TABLE 3-continued

| Number of Revolutions | Effect of Capacity Control (Pressure Drop Rate) | $K_2$ | Test Results |
|---|---|---|---|
| | | | was obtained. Sufficient performance for practical use. |
| | 12.0 | 0.080 | Effect of capacity control was slightly reduced. But with vehicles having displacement above 2000 cc, a preferable refrigerating cycle can be designed. |

Although the experimental data shown in FIG. 5 was obtained under conditions with the both inlet pressure Ps and outlet pressure Pd being held at constant, in the case of traveling actual vehicles the inlet pressure is reduced and the outlet temperature is increased while revolving at high speeds.

As a sequence, with no capacity control, compression work (torque) is increased due to an increase of compression ratio and also a condenser is subjected to overload because of high outlet temperature, thus resulting in damages of car coolers in the worst case. The more the condenser has large capacity, the more allowance against overload is increased, so that a larger-sized vehicle capable of including the compressor with higher capacity can produces increased allowance against excessive refrigerating capacity of the compressor.

It will be concluded from the results shown in Table 3 that a range of $K_2$ permitting effective application of this invention to practical use is given by $0.025 < K_2 < 0.080$ in consideration of difference in displacements of vehicles to be equipped with the compressors. By the way, as illustrated in FIGS. 4A and 4B, the input port 17 is positioned so as to keep an effective area of suction passage communicating with the vane chamber of the compressor at constant. With this arrangement, such advantageous features were achieved as (I) improvement in a characteristic of capacity control and (II) reduced cost due to facilitation or omission of machining process for the inlet groove. The reasons will be described hereinafter.

For example, in the case of the compressor having the inlet port 6 in the slide plate (rear panel) as illustrated in FIG. 1, an effective area of suction passage communicating with the vane chamber has a tendency to be gradually reduced in the final stage of a suction stroke where the vane 5 passes over the inlet port 6.

Figure 11:
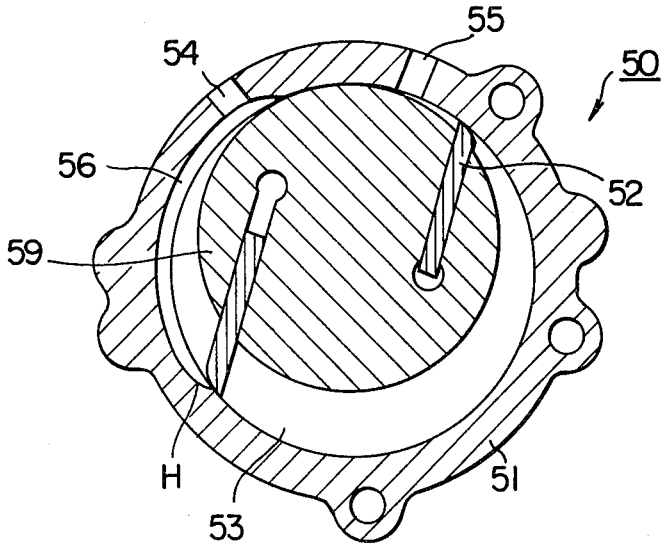
FIG. 11 is a front sectional view showing a second embodiment of a rotary compressor according to this invention.
Figure 12A:
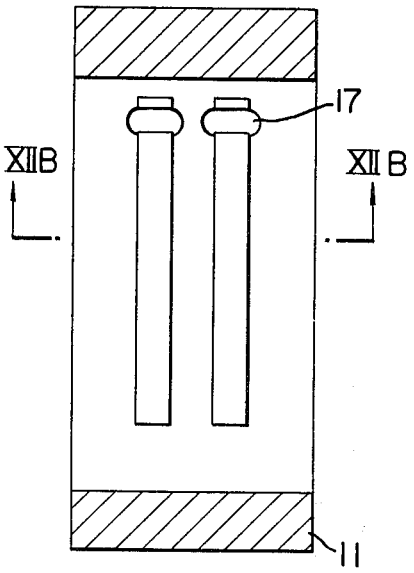
FIG. 12A is a side sectional view of the rotary compressor of FIG. 11.
Figure 12B:
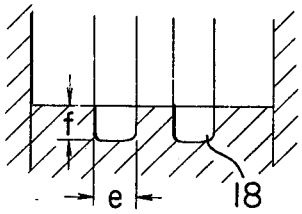
FIG. 12B is a sectional view taken along the line XIIB—XIIB in FIG. 12A.

In another arrangement, as shown in FIG. 11, wherein inlet grooves 56 and an inlet port 57 are formed in the inner surface of and through wall of the cylinder, respectively, and an effective area $S_1$ of the inlet grooves determined depending on a width e, depth f and the number of the inlet grooves 56 (referring to FIG. 12) is formed to be a little smaller than an area of the inlet port 54, an effective area of suction passage is throttled in the second half of a suction stroke.

In FIG. 11, a compressor 50 comprises a rotor 59, a cylinder 51, vanes 52, vane chambers 53, an inlet port 54, an outlet port 55 and inlet groove 56.

The curved surface of each inlet groove 56 corresponds to an outermost circumferential locus of a tool used and rotated in machining process. For example, when machining the inlet grooves 56 by a lathe, it is advantageous for mass production to employ an end mill with a larger diameter, but an effective area a ($\theta$) versus a travel angle of vane $\theta$ is gently reduced in a region immediately before the completion of a suction stroke as shown by P in FIG. 13.

Figure 13:
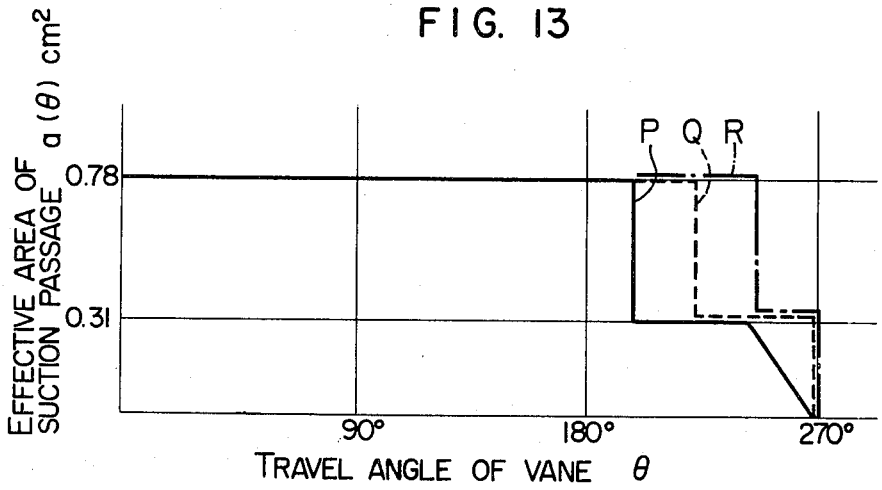
FIG. 13 is a graph showing a characteristic of effective area of suction passage $a(\theta)$ versus a travel angle of vane $\theta$ in the compressor of FIG. 11.

FIG. 13 shows an effective area of suction passage a($\theta$) versus a travel angle of vane $\theta$ for the following 3 cases. (Table 4) in the compressor such that its effective area of suction passage is varied during a suction stroke.

TABLE 4

| | Angle at which effective area is varied | |
|---|---|---|
| | $\theta s1$ | $\theta s2$ |
| P | 200 degrees | 250 degrees |
| Q | 220 | 270 |
| R | 240 | 270 |

Figure 14:
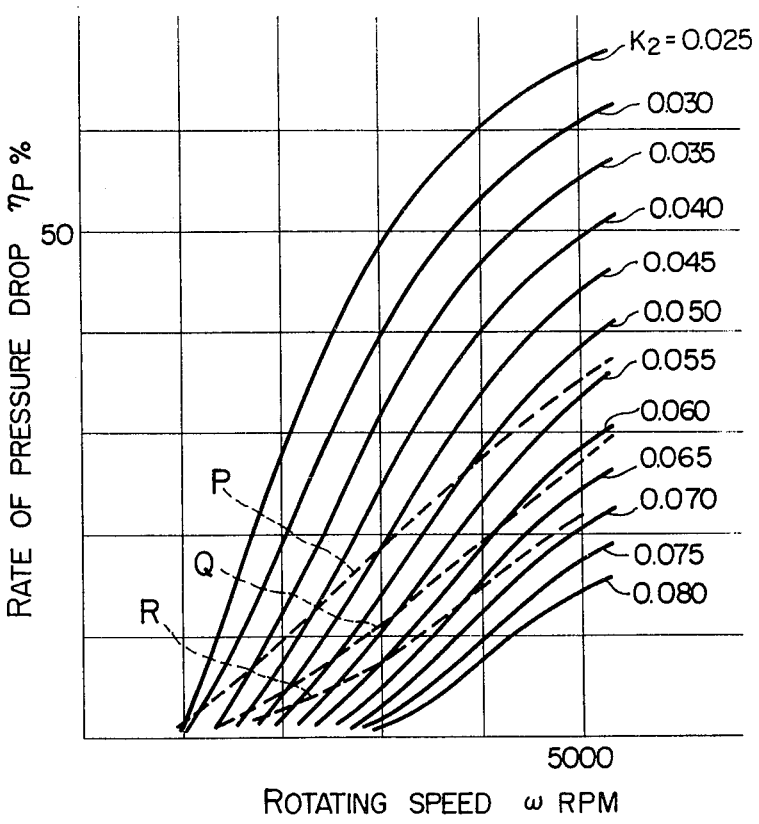
FIG. 14 is a graph showing a rate of pressure drop $\eta p$ versus rotating speed $\omega$ in the compressor of FIG. 11.

FIG. 14 shows a pressure drop rate versus rotating speed for the purpose of comparing characteristics of the following two cases with each other.

(I) In the case that an effective area of suction passage is varied during a suction stroke. For example, the first embodiment (FIG. 2) of this invention is included in this case.

(II) In the case that an effective area of suction passage is gradually reduced during a suction stroke.

For example, the compressors with structures as shown in FIGS. 1 and 11 are included in this case. In the case of (II) (corresponding to P, Q and R in FIG. 14), slope of the rate of pressure drop versus rotating speed becomes smaller than that in the case (I). More specifically, there occurs large loss of pressure while revolving at low speed and loss of pressure while revolving at high speeds is less increased.

It will be understood from such results that an effective area of suction passage is preferably to be kept at constant rather than to be gradually reduced during a suction stroke in a range with the parameter $K_2$ being properly determined, for the purpose of achieving an ideal characteristic of capacity control.

The inventors have already proposed Japanese Patent Application No. 55-134048 and proved such possibility that even in the compressor having the inlet port 54 arranged as illustrated in FIG. 11, an effective area of suction passage can be maintained constant during a suction stroke by so machining the inlet grooves 56 that they are formed to have a sufficient depth relative to an area of the inlet port 54 and also include no curved surfaces at the end portions thereof. With this arrangement, however, the end portion of each inlet groove 56 denoted by H in FIG. 11 has to be formed at a right angle with respect to the inner surface of the cylinder 11, thus resulting in some difficulty in machining process of mass production.

According to the arrangement of this invention, an effective area of the inlet path affecting a characteristic of capacity control for the compressor is determined by an area of the inlet port 7 or an area of the passage connecting the evaporator with the inlet port 17, which is not varied during a suction stroke. More specifically, as illustrated in FIG. 4A, refrigerant is supplied to the vane chamber 26a through the inlet groove 18 immediately after starting of a suction stroke. But, as regards the vane chamber 26a, the vane travel region in which the inlet groove 18 serves as a communicating path for supply of refrigerant corresponds to a region in which the vane 28a reashes to the inlet port 17 ($0<\theta<90°$). As will be described later, dimensions of suction passage in the first half of a suction stroke causes almost no influences upon finally reached pressure in the vane chamber. Therefore, machining accuracy of the inlet groove 18 affects a characteristic of capacity control at negligible degree, thus allowing fairly rough machining. For example, it becomes possible in mass production of the cylinder 11 that the inlet groove 18 is formed together in a die for the cylinder at the same time when producing it and then only the inlet port 17 machined with ease is bored and finished to high accuracy. Moreover, volume of the vane chamber 26a is very small in the region mentioned above ($0<\theta-90°$), so that the inlet groove 18 can be formed to have a sufficient shallow depth.

Figure 15:
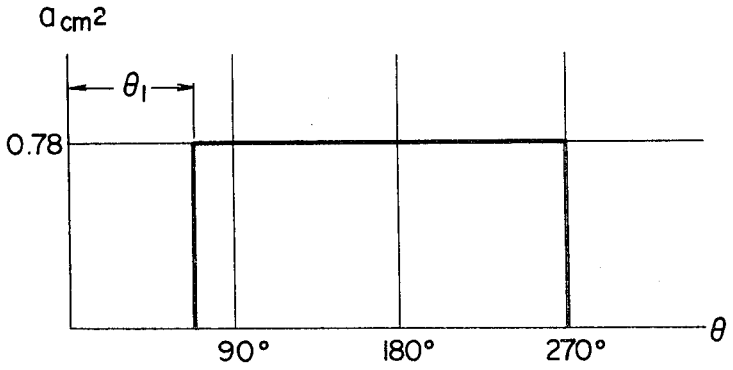
FIG. 15 is a graph showing an effective area of suction passage $a(\theta)$ versus a travel angle of vane $\theta$ when the inlet path is closed at the first half thereof in the compressor of FIG. 11.

In the following, the extent of influences upon the finally reached pressure by refrigerant will be studied in the case that the suction passage is closed for a certain region in the first half of a suction stroke as shown in FIG. 15, or in the case that supply of refrigerant to the vane chamber is interrupted in the above region. For the purpose of this study, the following numerical experiment was carried out by using the parameters in the Equation (10) other than an effective area $a(\theta)$ determined at specifications as given in Tables 1 and 2 setting $\omega=3600$ rpm.

Figure 16:
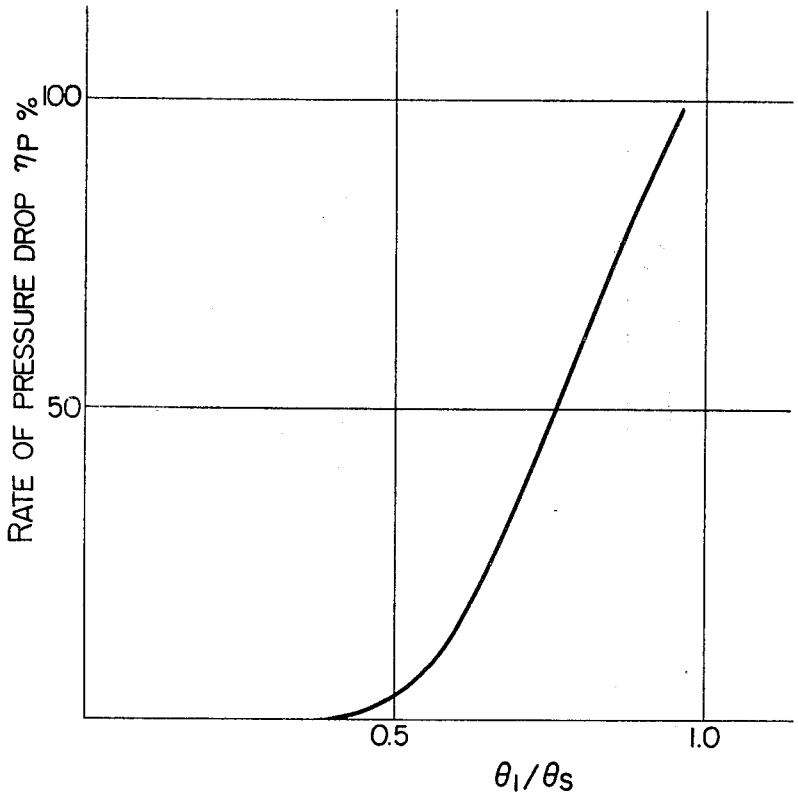
FIG. 16 is a graph showing a rate of pressure drop versus $\theta_1/\theta_s$ in the compressor of FIG. 11.

FIG. 16 shows a rate of pressure drop $\eta p$ versus ratio $\theta_1/\theta_s$, assuming that $\theta_1$ is a region as given in FIG. 15 where the suction passage is closed (or a region meeting $a(\theta)=0$). In a region of $0<\theta_1/\theta_s<0.5$, the presence or absence of the suction passage causes almost no influences upon the finally reached pressure. More specifically, it will be understood from FIG. 16 that the rate of pressure drop p at the completion of a suction stroke is not dependent on an opening or closing and also the degree of opening of the suction passage in the first half of a suction stroke, but determined by only an area of suction passge $a(\theta)=0.78$ cm$^2$ in the second half of a suction stroke.

Figure 17:
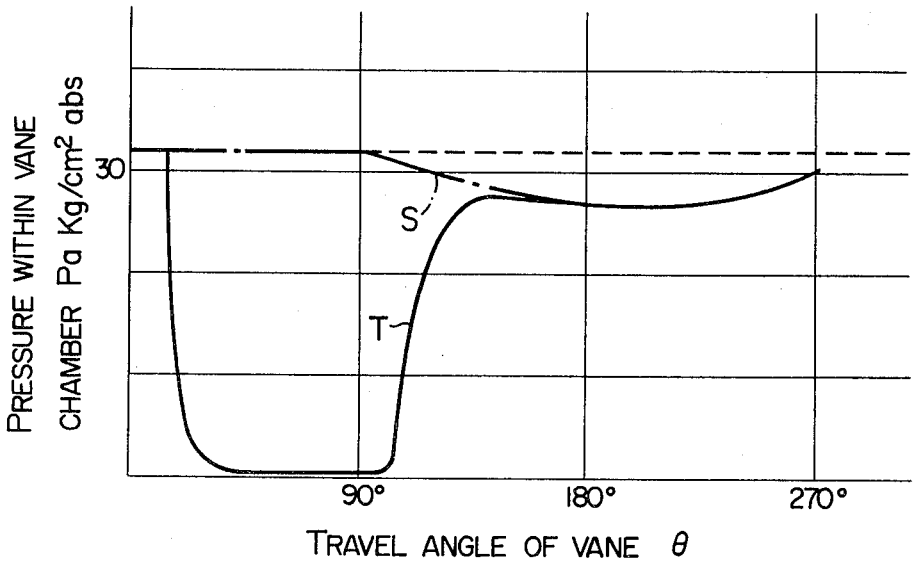
FIG. 17 is a graph showing a transient characteristic of pressure within the vane chamber Pa in the compressor of FIG. 11.

Referring to FIG. 17 in which there are shown transient characteristics of typical examples rendering the aforesaid result to compare with each other, a curve S represents the case that an area of suction passage is kept constant during the overall stroke and a curve T represents the case the suction passage is closed in a region of $0<\theta<0.37$. As to the curve T, pressure within the vane chamber Pa is greatly reduced in the range where the suction passage is closed, but then increased rapidly upon opening of the inlet path, so that there is found almost no difference between the both curves S and T at the time $\theta_s=270°$ when the suction stroke is completed. In the embodiment as shown in FIG. 2, the vane travel region where the inlet groove also serves as a suction passage for supplying refrigerant covers nearly $\frac{1}{3}$ of the overall stroke, and hence the finally reached pressure within the vane chamber is subjected to only negligible influences.

It is made clear from the result in the above that machining accuracy of the inlet groove 18 causes almost no influences upon a characteristic of capacity control. Incidentially, the inlet groove 18 formed between the inlet port 17 and the top portion of the cylinder has an effective role for preventing a partial increase of torque. Because, in the compressor wherein the inlet groove 18 is not formed and refrigerant is not supplied to the vane chamber 26a, the difference in pressure between the both vane chambers 26a and 26b is increased due to rapid pressure drop in the vane chamber 26a, thus leading to a partial increase of torque in a region of $0<\theta 90°$.

In the above, there have been described embodiments of this invention applied to a sliding vane type compressor with two vanes, but this invention is applicable any compressor irrespective its discharged amount, the number of vanes and type thereof. Although the discharged amount can be increased by eccentrically positioning the vanes with respect to the center of a rotor, it may be of course possible to use the vanes not eccentrically positioned.

Moreover, this invention is applicable to such compressors as including a plurality of vanes angularly spaced with not only the same interval but also the different intervals. In this case, capacity control according to this invention is applied to that vane chamber which has the maximum suction volume $V_O$.

The cylinder in the embodiment as mentioned above has a circular cross section, but another ellipse-type cylinder can be also employed. Moreover, this invention is further applicable to a compressor of single vane type such that a single vane is slidable fitted to extend through the rotor in the radial direction.

As clear from the foregoing description, according to the arrangement in which an inlet port is positioned so as to make an effective area of suction passage communicating with a vane chamber of a compressor constant immediately before starting of a suction stroke, a characteristic of capacity control is effectively improved and manufacturing cost can be reduced due to facilitation or omission of machining process for an inlet groove.

We claim:

1. In a compressor including a rotor having vanes slidably fitted thereto, a cylinder for receiving said rotor and vanes, side plates rigid on both sides of said cylinder and enclosing a space of each vane chamber defined by said vanes, rotor and cylinder at the sides thereof, and inlet and outlet ports each serving as a passage to communicate said vane chamber with the exterior, wherein said cylinder is oriented to have its top portion where a distance between the outer periphery of said rotor and the inner periphery of said cylinder becomes minimum, the improvement characterized in that said inlet port is positioned so as to make $a(\theta)$ almost constant, or meet $a(\theta)=\bar{a}$, in a range of $\frac{1}{2}\theta_s<\theta\leqq\theta_s$ and parameters of said compressor are determined to meet the following relation;

$$0.025<\theta_s\bar{a}/V_O<0.080$$

where, $\theta$(radian): angle from the top portion of the cylinder to the leading end of the vane, which is held in contact with the inner periphery of the cylinder, around the center of revolution of the rotor, $\theta_s$(radian): angle $\theta$ at the completion of a suction stroke, $V_O$(cc): volume of the vane chamber when $\theta$ undergoes $\theta_s$, and $a(\theta)$(cm$^2$): effective area of suction passage from an evaporator to the vane chamber.

2. A compressor according to claim 1, wherein said parameters $\theta_s$, $V_O$ and $\bar{a}$ are predetermined to meet the following relation;

$$0.035<\theta_s\bar{a}/V_O<0.070$$

3. A compressor according to claim 1, wherein said parameters $\theta_s$, $V_O$ and $\bar{a}$ are determined to meet the following relation;

$$0.040<\theta_s\bar{a}/V_O<0.065$$

* * * * *